US007921902B2

(12) United States Patent
Horoho

(10) Patent No.: US 7,921,902 B2
(45) Date of Patent: Apr. 12, 2011

(54) TUBULAR HEAT EXCHANGER

(75) Inventor: Scott Horoho, Mount Pleasant, SC (US)

(73) Assignee: BEHR GmbH & Co. KG, Stuttgart (DE)

( * ) Notice: Subject to any disclaimer, the term of this patent is extended or adjusted under 35 U.S.C. 154(b) by 796 days.

(21) Appl. No.: 10/592,506

(22) PCT Filed: Feb. 24, 2005

(86) PCT No.: PCT/EP2005/001903

§ 371 (c)(1),
(2), (4) Date: Nov. 15, 2007

(87) PCT Pub. No.: WO2005/095881

PCT Pub. Date: Oct. 13, 2005

(65) Prior Publication Data

US 2008/0135208 A1 Jun. 12, 2008

(30) Foreign Application Priority Data

Mar. 17, 2004 (DE) ..... 10 2004 013 383

(51) Int. Cl.
*F28D 1/02* (2006.01)

(52) U.S. Cl. ..... 165/81; 165/149

(58) Field of Classification Search ..... 165/81, 165/149

See application file for complete search history.

(56) References Cited

U.S. PATENT DOCUMENTS 3,165,151 A * 1/1965 Astrup et al. ..... 165/81
3,627,035 A * 12/1971 Astrup ..... 165/149
4,534,407 A * 8/1985 Lardner ..... 165/81
4,576,227 A * 3/1986 Cadars ..... 165/149
4,619,313 A * 10/1986 Rhodes et al. ..... 165/149
4,719,967 A 1/1988 Scarselletta
5,613,551 A * 3/1997 Rhodes ..... 165/149
5,954,123 A 9/1999 Richardson
5,992,514 A * 11/1999 Sugimoto et al. ..... 165/149
6,328,098 B1 12/2001 Kodumudi et al.
6,412,547 B1 * 7/2002 Siler ..... 165/81
7,198,095 B2 * 4/2007 Nguyen ..... 165/81
2004/0251002 A1 12/2004 Reichle et al.

(Continued)

FOREIGN PATENT DOCUMENTS

DE 37 22 605 A1 1/1989

(Continued)

*Primary Examiner* — Leonard R Leo
(74) *Attorney, Agent, or Firm* — Foley & Lardner LLP

(57) ABSTRACT

The invention relates to a frame part (10) for a tubular heat exchanger. The frame part (10) according to the invention is designed for being fastened (10) to a tubular body that is constituted of a number of parallel tubes through which a heat-exchange medium flows. The tubes run at both ends into a collecting tube which extends at an angle to the tubes. The tubular heat exchanger is provided with a frame part (10) on at least one of the sides of the tubular body that runs parallel to the tubes. Said frame part occludes the tubular heat exchanger from the exterior and can be at least indirectly linked with the collecting tubes. According to the invention, the frame part (10) has at least one predetermined breaking point (20). Said predetermined breaking point (20) is configured in such a mailer that, in the case of rupture, the frame part (10) is divided into two frame sections and that in the area of the predetermined breaking point (20) a frictional connection between the two otherwise separate frame sections is established.

11 Claims, 2 Drawing Sheets

U.S. PATENT DOCUMENTS

2005/0121178 A1 6/2005 Nguyen

FOREIGN PATENT DOCUMENTS

DE 197 53 408 A1 6/1999
DE 696 12 428 T2 7/2001
DE 102 55 011 A1 10/2003
DE 102 18 048 A1 11/2003
EP 1 001 241 A2 5/2000
EP 1 195 573 A1 4/2002
WO WO 03/091649 A1 11/2003

* cited by examiner

TUBULAR HEAT EXCHANGER

The present invention relates to a frame part for a tubular heat exchanger.

Tubular heat exchangers comprise a number of tubes which run parallel to one another and through which a heat exchange medium flows. The tubes running parallel to one another form a tubular body. On account of reasons concerned with the stability, the handling and the installation of tubular heat exchangers of this type, it is customary for the tubular body to be surrounded by frame parts at least on sides running parallel to the tubes. Such side parts for tubular heat exchangers are known, for example, from EP 1 001 241 A2.

Different heat loading and therefore different thermal expansion of frame parts and tubular body take place within the context of heat load cycles occurring during operation of the tubular heat exchanger. In this case, the problem is more serious the greater the length of the tubes. If the frame parts and the outer tubes, which are adjacent to the frame parts, of the tubular heat exchanger are mounted in a fixed manner with respect to one another, stress peaks occur in particular in the region in which the tubes are attached, the stress peaks putting the tightness of the tubular heat exchanger at risk, in particular in the region in which the tubes are attached. In order to counteract these stress peaks which occur in particular on the outer tubes adjacent to the frame parts, it is customary in the frame parts to provide expansion beads to compensate for the expansion in the longitudinal direction of the frame parts. The production of side parts with expansion beads is associated with a high outlay during production and exacting demands imposed on the forming tools.

By contrast, it is the object of the invention to provide a tubular heat exchanger with a frame part which can be produced cost effectively and such that it can be fitted and handled in a simple manner.

This object on which the invention is based is achieved by a tubular heat exchanger (see FIG. 3) according to the invention. A tubular heat exchanger 30 of this type is formed from a number of tubes 25 which run parallel to one another and through which a heat exchange medium flows. The tubes lead on both sides in each case into a collecting tube 31 running transversely to the extent of the tubes. On at least one of the sides of the tubular heat body that runs parallel to the tubes, the tubular heat exchanger has a frame part which closes off the tubular heat exchanger from the outside and can be connected at least indirectly to the collecting tubes. According to the invention, the frame part has at least one predetermined breaking point. The predetermined breaking point is designed in such a manner that, when the break is produced, the frame part is separated into two frame subsections.

The predetermined breaking point is advantageously designed in such a manner that the shear planes run essentially in the longitudinal direction of the frame part. This measure ensures in a particularly favorable manner that play is made possible in the longitudinal direction of the frame part between the two frame subsections, as is produced between tubular body and frame part in particular during different heat load cycles.

Owing to the fact that a predetermined breaking point is provided, the frame part, which was previously designed as a single piece, is broken into subsections. In the region of the predetermined breaking point, a compensation of different heat cycles is possible in the longitudinal direction of the frame part, and the required load elevation, in particular of the regions in which the tubes are fastened in the collecting tubes, is achieved. Under some circumstances, a certain connection is also obtained at the same time between the frame subsections, so that the frame part continues to ensure its function with regard to protecting the heat exchanger body from the penetration of dirt, and a certain flow-conducting function.

According to a preferred embodiment, in the region of the predetermined breaking point, a frictional connection is produced between the two frame subsections which are otherwise separated from each other. Under some circumstances, this ensures that the tubular heat body is stabilized despite the frame subsections having already been sheared off from each other.

A preferred configuration of a predetermined breaking point according to the invention is provided by the fact that one of the two frame subsections has a material tongue which protrudes into a C-shaped recess of the other frame subsection. The recess has end cheeks which bear laterally against the material tongue and, before the predetermined break is formed in this region, a connection of the two subsections is formed exclusively between end cheek and material tongue. This measure provides a single-piece frame part before the predetermined break is produced. There is a material-locking connection between the two frame subsections. According to a preferred configuration of the predetermined breaking point, after breaking takes place in the region of the predetermined breaking point between the cheeks in the C-shaped recess and the material tongue, an at least frictional connection is produced between the two frame parts. Owing to the fact that the cheeks of the C-shaped recess bear laterally against the material tongue, a clamping connection is formed between the cheeks and the material tongue. The material tongue is supported on both sides against a respective cheek. In the case of a heat load cycle, in particular during thermal expansion because of heating of the frame part, a thermal expansion is produced not only in the longitudinal direction of the frame part but also in the transverse direction thereto. The material tongue expands and the two cheeks have a tendency, on account of the thermal expansion, to move toward each other, so that the connection to frame subsections which are becoming hotter is subject to an increased bearing force and hence only a movement in the longitudinal direction of the frame part between material tongue and the cheeks is permitted. This longitudinal movement permits longitudinal play in the frame part while at the same time, via the frictional connection in the transverse direction thereto and in the vertical direction, the two subsections are securely held against each other.

In a preferred refinement of the invention, before the predetermined break is produced, a weakened material bridge is provided between the cheeks of the one frame subsection and the material tongue of the other frame subsection. According to a preferred refinement, the weakening of the material bridge can be obtained in particular by a reduced material thickness in this region of the frame part. The weakening is introduced into this region in particular during molding of the frame part. According to a particularly preferred refinement—because it can be produced in a simple and cost-effective manner—the frame part is designed as a punched part. During the punching operation, for each predetermined breaking point, first recesses are punched out of a blank on both sides and lying opposite each other and extend from the edge of the frame part as far as the side of the material tongue. Offset axially thereto and defining the end of the material tongue, a recess is punched out of the material of the frame part, the second recess being enclosed on all sides by material of the frame part. The material bridge is punched on both sides of the tongue into the material of the frame part and extends along the side flank of the tongue from one of the two first recesses toward the second recess, to be precise essentially along the longitudinal direction of the frame part. The material bridge therefore defines the lateral boundary of material tongue to frame part or the cheeks of the C-shaped recess. The effect achieved by this measure is that the frame part can be produced in a single punching operation and at the same time the material weakenings for defining the material bridge can be introduced. A single working step needs to be carried out, and the production can be carried out largely in a single machining step, namely the punching operation. Only deforming operations, for example the insertion of a longitudinal profile (for example by producing a U-shaped cross section of the frame part) by corresponding bending of the blank along bending edges running in the longitudinal direction of the frame part may make subsequent further machining steps necessary.

Preferred refinements of the invention make provision for one of the two frame subsections to have a slotted guide 40 (see FIG. 1) for fastening the frame part in the region of the collecting tube. The slotted guide makes it possible to compensate for manufacturing tolerances in the region in which the frame part is fastened to the rest of the tubular heat exchanger.

According to further preferred refinements of the frame part, the production of the predetermined break in the region of the predetermined breaking point occurs at the latest during the occurrence of the first operationally induced heat load cycle, in particular before a first stationary operating state is reached. According to a further preferred refinement, the breaking in the region of the predetermined breaking point already occurs during the fastening of the frame part to the heat exchanger or of the heat exchanger in the vehicle. Appropriate dimensioning of the material bridge and of the weakening in the region of the material of the material bridge make it possible to define the loading at which the break along the predetermined breaking point occurs. If the break occurs during the fastening of the frame part to the heat exchanger or during the fastening of the heat exchanger together with the frame in the vehicle, it is ensured that, even before the first heat loading, in the region of the breaking point there is longitudinal play which is required for the possibility of a stress-free thermal expansion. However, it is sufficient if the break occurs during the first thermal loading in the context of a customary heat load cycle, to be precise at a time before a first stationary operating state is achieved. This measure always ensures that, during normal operation, when the heat exchanger is started up, the predetermined break in the predetermined breaking point is formed in good time.

According to a preferred refinement of the invention, a frame part has two predetermined breaking points of this type, so that a central section is formed which is connected in each case to an end section via material bridges on both end sides. According to a preferred refinement, the two predetermined breaking points or material bridges in the end fastening position bear against the heat exchanger in such a manner that the predetermined breaking points lie in the region of the transition of the tubes of the tubular body to the collecting tube. It is precisely in this region that stress peaks occur due to the thermal loading and the thermal load reversal cycles. The formation of the predetermined breaking points in this region ensures that, in these sections through the frame part, the connecting points are not subjected to additional loadings, with the result that the tightness of the connecting points continues to be ensured over a long period of time and damage does not occur. According to a preferred refinement, the central section has on both sides a respective C-shaped recess, and the end sections each have a material tongue protruding into one of the two recesses of the central section.

Furthermore, the invention is also explained in more detail below with reference to the exemplary embodiment illustrated in the drawings, in which.

Figure 1:
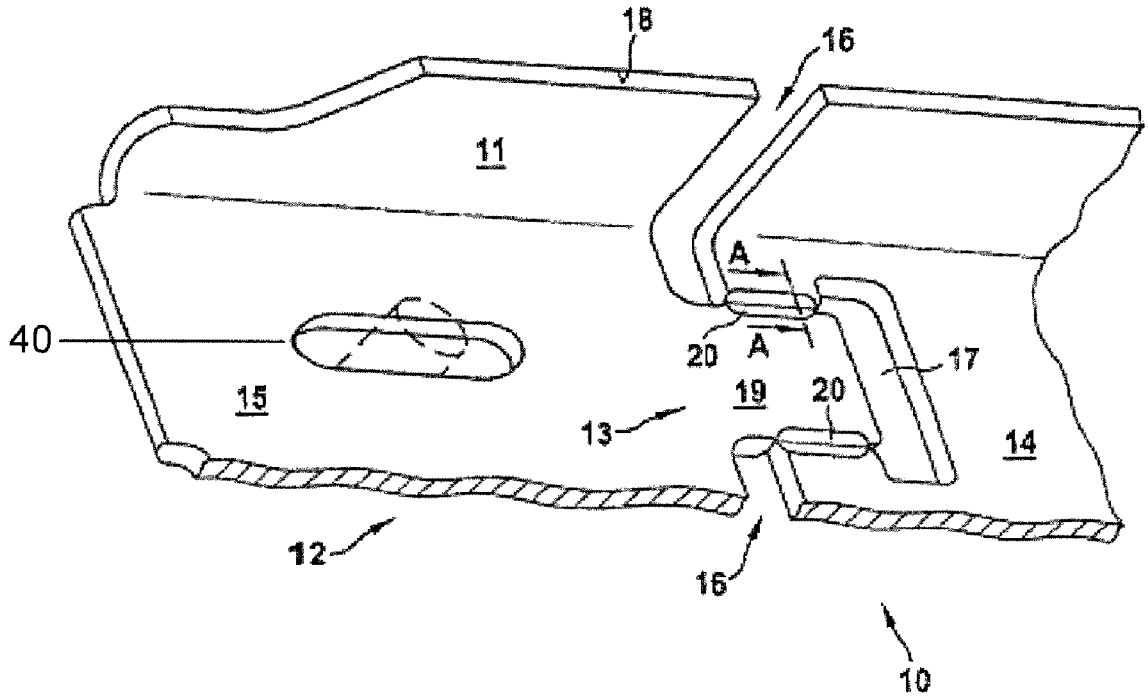
FIG. 1 shows a cut away oblique pictorial illustration of a frame part according to the invention in the region of the predetermined breaking point.

FIG. 1 shows a frame part 10 in an oblique pictorial illustration. In the partially cut away illustration, the frame part, which is of U-shaped design, is illustrated in cut away fashion such that one of the two side flanks 11 which is bent through 90° with respect to the basic surface 12 is not illustrated so as to free the view of the configuration of the basic surface 12 with the fastening region 13.

The frame part extends over a relatively long section in the longitudinal direction, with it being possible, as already explained above, for a fastening region 13 also to be formed at the other end of the frame part, so that FIG. 1 shows the end section of a frame part that is also present mirror-symmetrically.

The central section 14 and an end section 15 which are connected to each other in the fastening region 13 can be seen in FIG. 1. In this case, the frame part 10 is designed as a punched part, with two first recesses 16 and a second recess 17 being punched out of the material, lying opposite each other. The first recesses 16 reach from the edge 18 of the frame part transversely to the longitudinal direction as far as the material tongue 19. The second recess 17 is surrounded all the way around by material of the frame part 10 and is offset axially with respect to the two first recesses 16. Two predetermined breaking points 20 are formed bounding the material tongue 19 laterally, each of the predetermined breaking points reaching from a first recess 16 to the second recess 17 and extending in the longitudinal direction of the frame part. The second recess therefore defines the core of the C-shaped recess while the material section which reaches between the two predetermined breaking points 20 as far as the second recess 17 and belongs to the end section 15 forms the material tongue 19, the latter also being laterally bounded over a short section by the edge of the first recesses.

Figure 2:
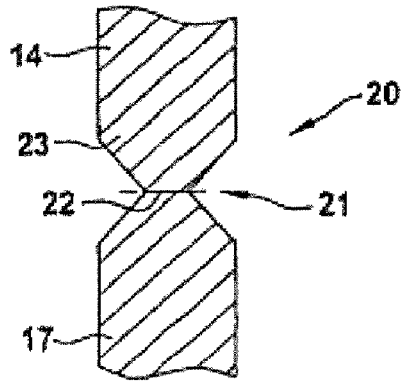
FIG. 2 shows a longitudinal section through the predetermined breaking point according to FIG. 1.
Figure 3:
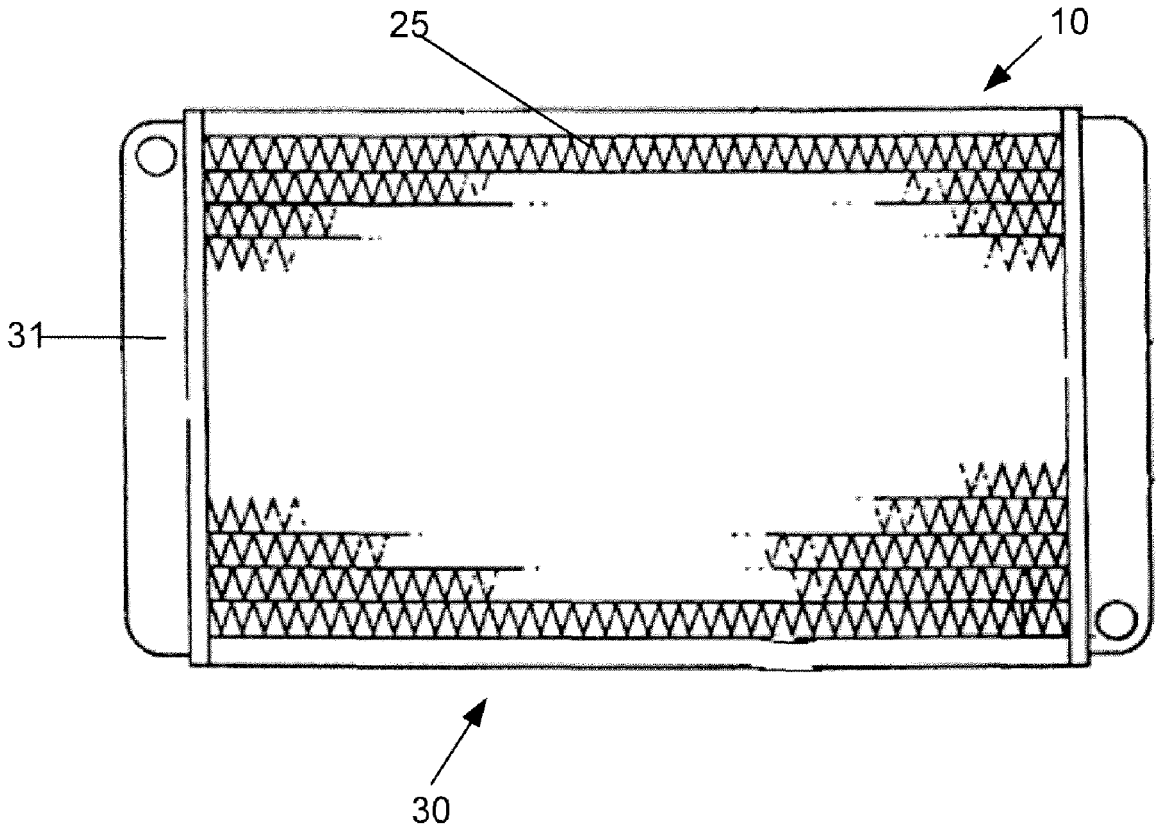
FIG. 3 shows an exemplary heat exchanger formed from a number of tubes.

FIG. 2 shows the section along the section line AA through one of the two predetermined breaking points 20 of FIG. 1. The predetermined breaking point itself is formed by the material tongue 21 of reduced material thickness which then breaks along the shear plane 22, so that a further bearing of the two parts against each other is formed along this line. The material of the central section 14 is illustrated at the top in the drawing while the material of the material tongue 19 of the end section 15 is illustrated graphically on the lower side. In this case, the central section 14 forms the cheek 23 which bears laterally against the material tongue 19, to be precise precisely along the shear plane 22.

The invention claimed is:

1. A tubular heat exchanger, in which a heat exchange medium flows, comprising:

a number of tubes, through which the heat exchange medium flows, the tubes running parallel to one another and configured to form a tubular body;

collecting tubes, oriented transversely to the tubes, wherein ends of the tubes are configured to lead into the collecting tubes; and a frame part, configured to bind at least one side of the tubular body and running parallel to the tubes of the tubular heat exchanger, wherein the frame part includes at least one predetermined breaking point, the at least one predetermined breaking point dividing the frame part into two frame subsections, and at least one shear plane of the at least one predetermined breaking point running essentially in a longitudinal direction of the frame part, wherein, in a region of the at least one predetermined breaking point, when breaking takes place a frictional connection is produced between the two frame subsections, and wherein, in the region of the at least one predetermined breaking point, one of the two frame subsections includes a material tongue which protrudes into a C-shaped recess of the second of the frame subsections, the recess including end cheeks which bear laterally against the material tongue, with a connection of the two frame subsections being formed exclusively in the region and in a form of a weakened material bridge which forms the at least one predetermined breaking point.

2. The tubular heat exchanger as claimed in claim 1, wherein, after the predetermined break is produced between the cheeks of the C-shaped recess and the material tongue, a frictional connection is produced between the two frame subsections.

3. The tubular heat exchanger as claimed in claim 1, wherein weakening of the material bridge is obtained by a reduced material thickness in the region, with the weakening being introduced during molding of the frame part.

4. The tubular heat exchanger as claimed in claim 3, wherein the frame part can be produced by punching, with, for each predetermined breaking point, first recesses being punched out of a blank on both sides and lying opposite each other and protruding from an edge of the frame part as far as the material tongue, and a second recess which is offset axially thereto being punched out, and with the second recess being enclosed all around by material of the frame part and, on both sides of the material tongue, a respective material bridge being punched in, said material bridge extending in a direction of longitudinal extent of the frame part from the second recess to one of the two first recesses.

5. The tubular heat exchanger as claimed in claim 1, wherein one of the two frame subsections includes a slotted guide for fastening the frame part in a region of the collecting tube.

6. The tubular heat exchanger as claimed in claim 1, wherein the predetermined break in the region of the predetermined breaking point occurs at the latest during occurrence of a first operationally induced heat load cycle.

7. The tubular heat exchanger as claimed in claim 1, wherein the frame part includes two predetermined breaking points, so that a central section and two end sections are formed, the two predetermined breaking points being arranged in such a manner that, when the frame part is fastened to the heat exchanger, the predetermined breaking points lie in a vicinity of a transition from the collecting tube to the tubular body.

8. The tubular heat exchanger as claimed in claim 7, wherein the central section includes on both sides a respective C-shaped recess into which the material tongue of one of the end sections protrudes.

9. The tubular heat exchanger as claimed in claim 1, wherein the predetermined break in the region of the predetermined breaking point occurs before a first stationary operating state is reached.

10. The tubular heat exchanger as claimed in claim 1, wherein the predetermined break in the region of the predetermined breaking point occurs during fastening of the frame part to the heat exchanger.

11. A tubular heat exchanger, in which a heat exchange medium flows, comprising:

a number of tubes, through which the heat exchange medium flows, the tubes running parallel to one another and configured to form a tubular body;

collecting tubes, oriented transversely to the tubes, wherein ends of the tubes are configured to lead into the collecting tubes; and a frame part, configured to bind at least one side of the tubular body and running parallel to the tubes of the tubular heat exchanger, wherein the frame part includes two predetermined breaking points, so that a central section and two end sections are formed, the two predetermined breaking points being arranged in such a manner that, when the frame part is fastened to the heat exchanger, the predetermined breaking points lie in a vicinity of a transition from the collecting tube to the tubular body, wherein at least one shear plane of at least one of the two predetermined breaking points runs essentially in a longitudinal direction of the frame part, and wherein the central section includes on both sides a respective C-shaped recess into which the material tongue of one of the end sections protrudes.

* * * * *